US005233840A

United States Patent [19]

Scaringe

[11] Patent Number: 5,233,840

[45] Date of Patent: Aug. 10, 1993

[54] METHOD AND APPARATUS FOR COOLING REFRIGERANT RECOVERY SYSTEM TANKS AND THE LIKE

[75] Inventor: Robert P. Scaringe, Rockledge, Fla.

[73] Assignee: Mainstream Engineering Corporation, Rockledge, Fla.

[21] Appl. No.: 932,000

[22] Filed: Aug. 19, 1992

[51] Int. Cl.[5] ..... F25B 45/00

[52] U.S. Cl. ..... 62/77; 62/292; 165/46

[58] Field of Search ..... 62/77, 84, 195, 149, 62/292, 475; 220/467; 165/46

[56] References Cited

U.S. PATENT DOCUMENTS 4,761,961 8/1988 Harx ..... 62/77

4,856,294 8/1989 Scaringe et al. ..... 165/46

*Primary Examiner*—John M. Sollecito

*Attorney, Agent, or Firm*—Evenson, McKeown, Edwards & Lenahan

[57] ABSTRACT

A wrapper which has a phase-change material therein is wrapped around the outer circumference of a tank used to store saturated condensed used refrigerant evacuated from a refrigeration system. The phase-change material acts as a heat exchange medium by changing between solid and liquid phases at its melting/freezing temperature selected from a particular temperature range and thus served to provide a large thermal driving force so as to cool the tank. The selected material is normally one that can be brought into its solid phase merely by contact with ice and/or remain in its solid phase for long periods without itself being refrigerated.

2 Claims, 2 Drawing Sheets

METHOD AND APPARATUS FOR COOLING REFRIGERANT RECOVERY SYSTEM TANKS AND THE LIKE

BACKGROUND AND SUMMARY OF THE INVENTION

Protection of the earth's ozone layer has recently been mandated by the federal government Refrigerant and fire-extinguisher Halon is now removed from refrigerant devices using a recovery device. These devices typically use a compressor to draw the refrigerant from the system to be emptied. The recovery device then condenses the refrigerant which is then piped to an external, small portable storage tank. These tanks become quite hot, however, during the recovery operation. Since the refrigerant inside the tank is at saturated conditions, this warm tank causes an increased high-side (condenser) pressure. The result of a higher condenser pressure is a decrease in the rate of refrigerant recovery. This is a critical problem since recovery rate of portable units are already slow.

Simply immersing the storage tank in ice-water would lower the storage tank temperature and therefor the storage tank pressure, thereby improving the recovery rate. Maintaining sufficient ice during an 8-hour work day is, however, difficult because the user would have to carry a large pail to contain the storage tank and ice-water mixture. Another approach would be to use a one-time endothermic (salt-water) chemical cooling reaction.

An object of the present invention is to solve the foregoing problems by using a phase-change material contained in flexible material which can be wrapped around the tank. The use of a phase-change material in a vest to be worn by a person is disclosed in U.S. Pat. No. 4,856,294. Rather than use ice which cannot be refrozen unless it is cooled below 32° F., the present invention contemplates the use of individual packs containing phase-change material held in a cloth device which wraps around the storage tank. These packets contain a phase-change material which melts in the range of 40°-95°0 F., thereby providing the necessary storage tank cooling. During a typical refrigerant recovery, the storage tank external surface temperature exceeds 135° F. Cooling to below 80° significantly improves the recovery rate, and the colder the storage tank the greater the recovery rate.

BRIEF DESCRIPTION OF THE DRAWINGS

These and further objects, features and advantages of the present invention will become apparent from the following detailed description of a currently contemplated embodiment when taken in conjunction with the accompanying drawings wherein.

DETAILED DESCRIPTION OF THE DRAWINGS

Figure 1:
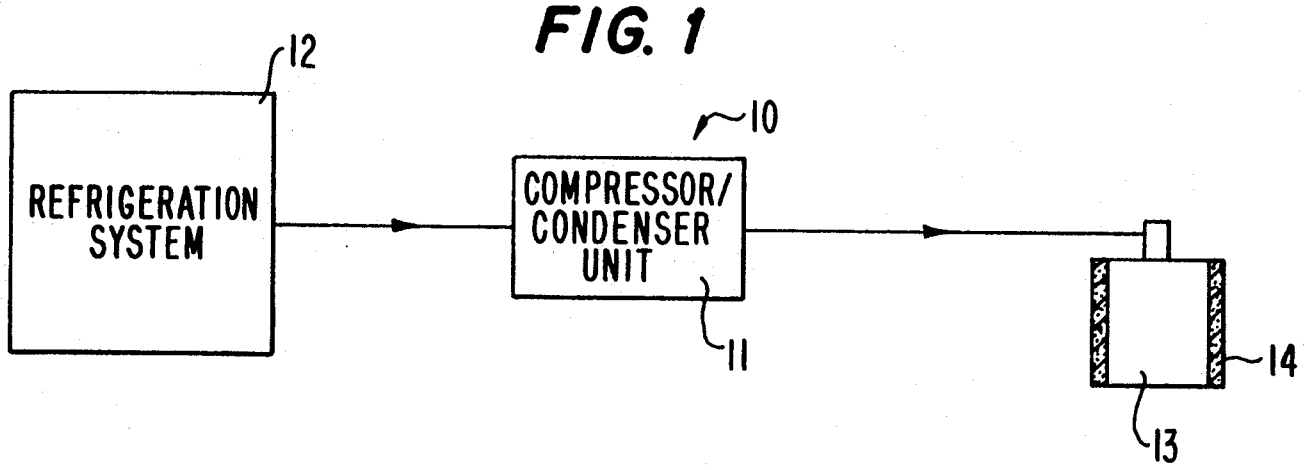
FIG. 1 is a schematic view of the wrapper of the present invention used with the tank of a conventional refrigerant recovery system.

A conventional refrigerant recovery system designated generally by the numeral 10 includes a compressor 11 which draws refrigerant from a system 12 to be emptied. The recovery system 10 then condenses the refrigerant and supplies the condensed refrigerant at saturation to a separate, small portable tank 13. The tank 13 is thus warmed by the saturated refrigerant. To solve the problem, the present invention utilizes a phase-change material in a flexible tank wrapper 14 utilizing a similar principle disclosed in the aforementioned U.S. Pat. No. 4,856,294. In fact, the tank wrapper 14 can be constructed substantially along the same lines as the double-wall construction in the patent which discloses a number of suitable phase-change materials.

Figure 2:
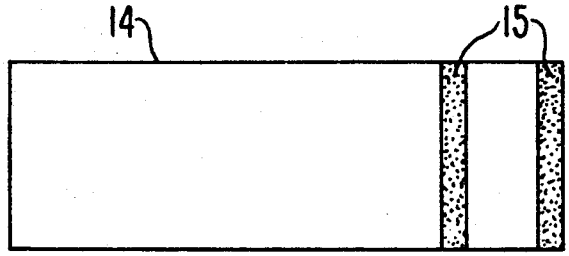
FIG. 2 is a plan view of the outer surface of the wrapper used on the tank in FIG. 1 but in a rolled-out state.
Figure 3:
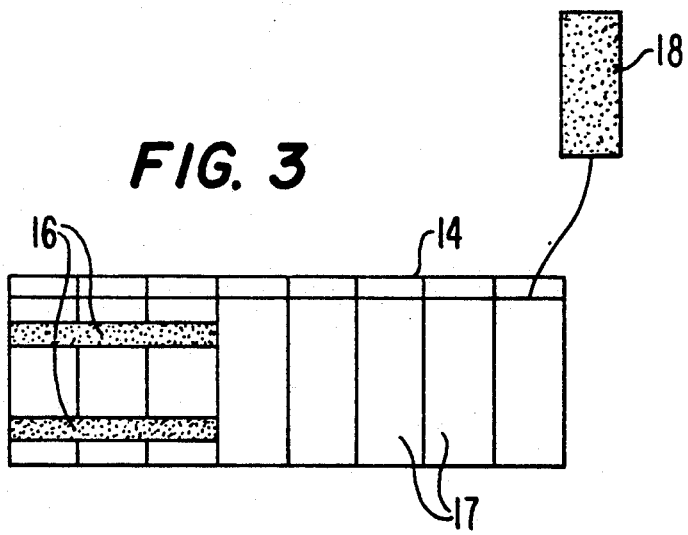
FIG. 3 is a plan view of the inner surface of the wrapper of FIG. 2.
Figure 4:
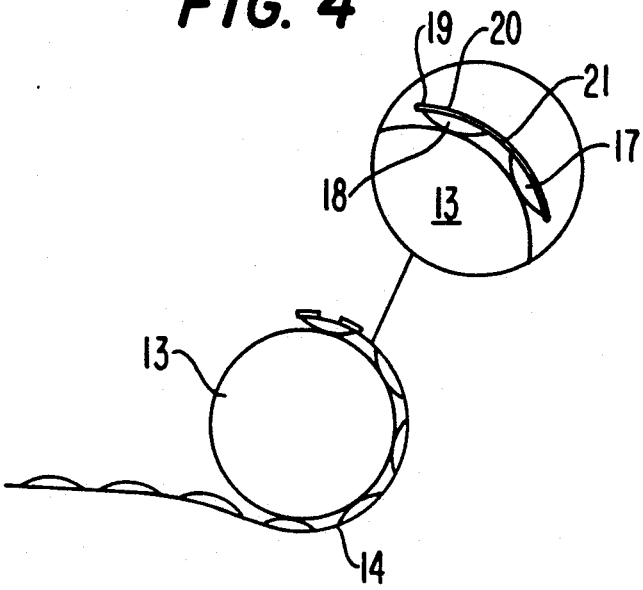
FIG. 4 is a plan view of the tank of FIG. 1 with the wrapper of FIGS. 2 and 3 partially placed thereon and with an isolated enlarged view showing the double-walled construction of the wrapper.

As shown in more detail in FIGS. 2-4, the wrapper 14 can be provided on its outer surface with two vertically-disposed "Velcro" brand strips 15 placed near one end to engage with horizontally disposed "Velcro" brand strips 16 placed on the other end on the inner surface. These arrangement of the strips 15, 16 allows the wrapper 14 to be used with a wider variety of tank diameters. The wrappers 14 have pockets 17 on the inner surface to hold packets 18 of the phase-change material in polymeric bags. The wrapper 14 comprises an outer fabric 19, insulation 20 such as "Thinsulate" brand insulation, inner fabric 21 and the previously mentioned fabric pockets 17 on the inner surface.

To the extent a large temperature range is desired for this particular refrigerant recovery system application, one of ordinary skill in the art will be able to identify suitable phase change material other than those disclosed in U.S. Pat. No. 4,856,294. For example, use of a phase-change material such as n-tetradecane which changes phase at 42° F. in the pockets 17 in the tank wrapper 14 provides, on one hand, a 48° F. thermal driving force (i.e., cooling temperature difference). If, on the other hand, the tank temperature is maintained at 90° F. and ice were used to cool the tank, the temperature difference is 58° F. Moreover, the 42° F. phase-change material can be easily refrozen in the field merely by storing these cooling packets in a portable cooler with ice, whereas ice-packets cannot be refrozen merely by contact with ice.

As an alternative embodiment, the use of a 65° F. phase change-material provides a lower thermal driving force, resulting in a higher storage tank temperature, but still yields improved performance compared to an uncooled tank 13, and in the field it will remain frozen without being in a cooler, for much greater period of time.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. In a method for cooling a refrigerant recovery system storage tank for saturated condensed refrigerant, the improvement comprising the step of placing a heat exchange material that changes between solid and liquid phases at its melting/freezing temperature in a range from about 40° F. to 95° F. in its solid phase in thermal communication with an outer surface of the tank.

2. In the method according to claim 1, the step of placing includes wrapping a flexible material containing the heat-exchange material around substantially the entire outer surface of the tank.

* * * * *